United States Patent [19]

Andrews et al.

[11] 3,947,980

[45] Apr. 6, 1976

[54] PROCESS AND APPARATUS FOR DEEP-SEA PARTICLE HARVESTING

[75] Inventors: James E. Andrews, Kailua; Maurice E. Morgenstein, Kaneohe, both of Kaneohe, Hawaii

[73] Assignee: Hawaii Marine Research, Inc., Kaneohe, Hawaii

[22] Filed: Feb. 10, 1975

[21] Appl. No.: 548,473

[52] U.S. Cl. ..... 37/69; 37/195; 37/DIG. 8; 299/18

[51] Int. Cl.[2] ..... E02F 3/14

[58] Field of Search ..... 37/55, 57, 60, 69, 71, 37/195, DIG. 8; 299/8, 9, 10, 18; 115/7, 8

[56] References Cited

UNITED STATES PATENTS

| | | | |
|---|---|---|---|
| 82,376 | 9/1868 | Boschke | 37/69 |
| 610,763 | 9/1898 | Kibling | 37/69 |
| 991,333 | 5/1911 | Lybeck | 37/57 X |
| 1,190,224 | 7/1916 | Drouard | 37/57 |
| 1,705,428 | 3/1929 | Twiford | 37/57 X |
| 2,217,412 | 10/1940 | Jackson et al. | 37/55 |
| 2,978,819 | 4/1961 | Paulson | 37/57 |
| 3,238,708 | 3/1966 | Zickefoose | 37/55 X |
| 3,540,226 | 11/1970 | Sherrod | 115/7 X |
| 3,672,079 | 6/1972 | Matsuda et al. | 37/69 |

FOREIGN PATENTS OR APPLICATIONS

| | | | |
|---|---|---|---|
| 692,998 | 8/1964 | Canada | 37/58 |
| 780,571 | 4/1935 | France | 299/9 |

*Primary Examiner*—E. H. Eickholt
*Attorney, Agent, or Firm*—Townsend and Townsend

[57] ABSTRACT

An apparatus and process for harvesting deep-sea particles, such as nodules, from a substantially planar deep-sea bottom is disclosed. A vessel on the surface tows a heavier than water sled along the ocean bottom. Towing occurs through a single towing strip connected to the sled at the lower end, connected to the vessel at the upper end, and extending angularly downward from the vessel to the sled. The towing strip includes an integral elevator mechanism comprising in the preferred embodiment a series of buckets having perforated sides conveyed by and on an endless belt traveling on the towing strip. The series of buckets on the endless belt empties a concentrator collector having the accumulated and harvested particles in the towed sled. The buckets ride upwardly from the sled to the surface vessel on a first track on the towed strip. The bucket contents are then emptied at the surface typically within the vessel, and thereafter are reconveyed to the sled on a second and separate track on the towing strip. Thus, a process is disclosed of towing a collector; scraping particles and sediment from the oceam bottom at the collector; concentratingn the particles at the collection point interior of the collector, free of ambient sediment; and, continuously conveyinr in a series of buckets the particles to a collection area above the surface of the sea.

12 Claims, 7 Drawing Figures

FIG _ 3
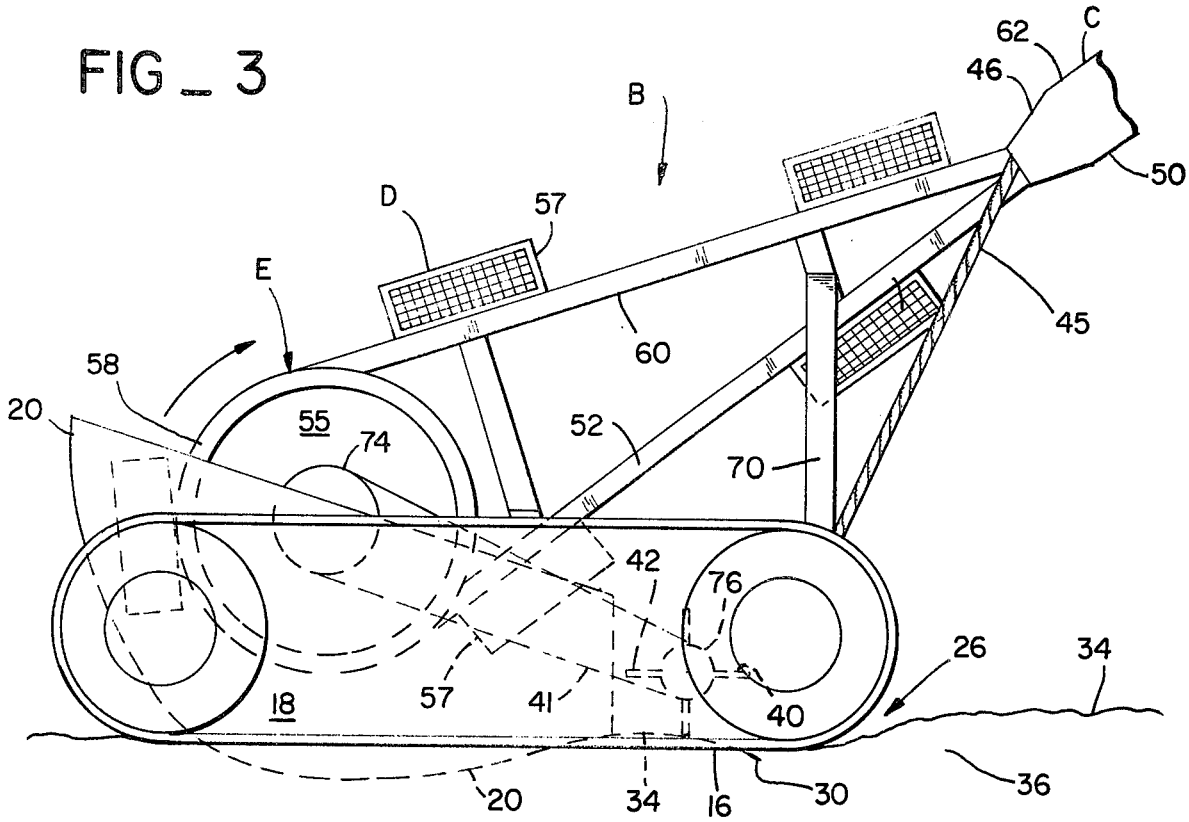
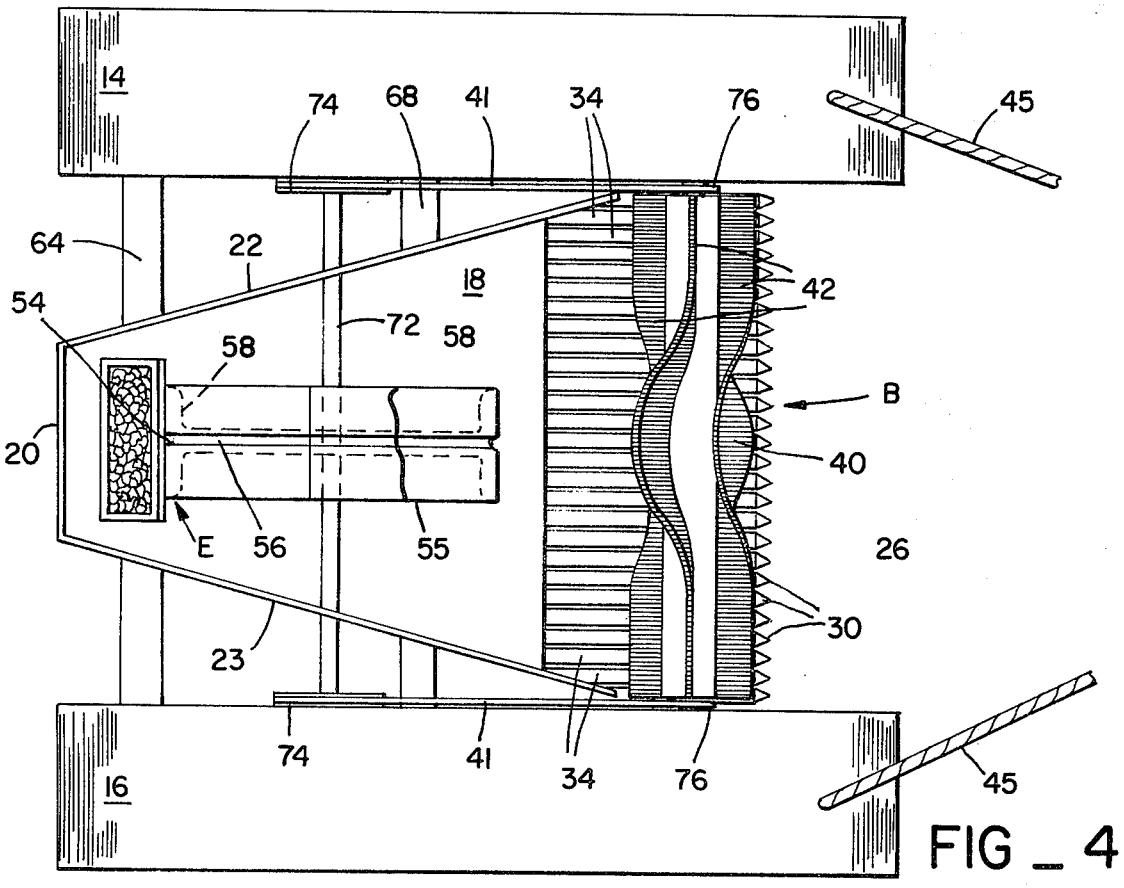
FIG _ 4

PROCESS AND APPARATUS FOR DEEP-SEA PARTICLE HARVESTING

This invention relates to submarine mining. More particularly, a process and apparatus for deep-sea particle harvest for ferromanganese nodules and crusts; phosphorite nodules and crusts; sands; and, precious corals from a deep-sea bottom at the sediment water interface.

STATEMENT OF THE PROBLEM

It has been found and is known that the sediment water interface of deep-sea bottoms is mineral rich in many areas. For example, ferromanganese nodules and phosphorite nodules in the range of 2 to 20 centimeters of diameter (average diameter 5 to 8 centimeters) are found. These nodules are typically round, have a density of approximately 2.4 times that of water, and are found as a monolayer in the sediment water interface at a deep-sea bottom. Such nodules can have variable surface density on the ocean bottom frequently ranging from 10 to 20 kilograms per meter squared of sea bottom. They are commonly found below 1,000 feet of ocean and can be as deep as 15,000 to 20,000 feet in the ocean. Additionally, precious corals and phosphate nodules and crusts are also found on the sea bottom.

These particles are commonly at least partially immersed in a water-saturated sediment or ooze. Typically, the ooze comprises small particles of around 200 microns diameter with a density of 1.8 to 2 times that of water. Unlike the nodules, crusts, corals and sands, the porosity of the surrounding sediment is in the range of 70% to 85% with the water content in the range of 200% to 400%. Thus, as to mineral particles at the sediment water interface, these particles are typically at least partially immersed in an "ooze" ground or sediment condition not known to air exposed earth. Consequently, these particles present their own unique submarine mining problems.

SUMMARY OF THE PRIOR ART

Heretofore, devices for harvesting particles from the sediment water interface on the sea bottom have been comprised of two generic types. First, a series of independently towed collector buckets have been utilized to attempt ocean bottom harvest. (See Matsuda et al. U.S. Pat. No. 3,672,079.) Regarding such independently towed collector buckets, these buckets are typically dragged in series along a random and wide path swathe defined by a long segment of a larger, typically endless loop of wire draped over separate points on one vessel or selected points on paired and spaced apart vessels. Thus, the buckets collect minerals from no central collection point but rather collect particles from a long and indeterminate swathe. Monitoring of the collection is not possible, nor is precise control of the rate of mineral particle collection from the ocean bottom possible.

Moreover, buckets independently suspended from and towed by a long, unrestrained loop of wire frequently entangle. The handling of both the buckets and the wire holding the buckets together on a free and unrestrained path without entanglement is extremely difficult.

The second proposed solution to this type of mining has included a vehicle which is typically self-powered and elevates through a fluid conduit or pipe mineral particles entrained in an upwardly and rapidly rising column of water. An example of such an apparatus is shown in Steele et al. U.S. Pat. No. 3,504,943.

This solution to the mining problem is not without difficulty. First, the sediment ambient in which the mineral particles are typically located is entrained upwardly with the particles themselves. Thus, the sediment is taken from the sea bottom environment and moved to the vicinity of the surface where it constitutes a pollutant which can only be classified out from the entraining water with extreme difficulty. The settlement of such sediment through the ocean overlying the bottom constitutes a serious pollutant to ambient sea life.

Additionally, where the conduit flow upwardly from the vehicle on the ocean floor to the surface vessel ceases for any reason, plugging or bursting of the conduit frequently occurs. Typically, the long column of water entrained harvested particles rapidly settles with great hydrostatic pressure to the bottom of the conduit. Upon such settlement, either plugging or bursting of the conduit can occur.

Additionally, the conduit which transports such particles to the surface is not suitable for towing a vehicle. Therefore, the vehicle which constitutes the collection point on the ocean bottom must also be self-motorized. This complicates the apparatus at the ocean floor.

Finally, it is not uncommon for such sea bottoms to have mild elevational changes as well as the vessel on the surface to ride upon sea swells. Where a conduit runs directly from an underlying vehicle to the surface of the ocean, elevational changes in the depth between the vessel and collecting vehicle on the ocean floor are not easy to accommodate in conduits running directly from the ocean floor to an overlying vessel.

SUMMARY OF THE INVENTION

An apparatus and process for harvesting deep-sea particles, such as nodules, from a substantially planar deep-sea bottom is disclosed. A vessel on the surface tows a heavier than water sled along the ocean bottom. Towing occurs through a single towing strip connected to the sled at the lower end, connected to the vessel at the upper end, and extending angularly downward from the vessel to the sled. The towing strip includes an integral elevator mechanism comprising in the preferred embodiment a series of buckets having perforated sides conveyed by and on an endless belt traveling on the towing strip. The series of buckets on the endless belt empties a concentrator collector having the accumulated and harvested particles in the towed sled. The buckets ride upwardly from the sled to the surface vessel on a first track on the towed strip. The bucket contents are then emptied at the surface typically within the vessel, and thereafter are reconveyed to the sled on a second and separate track on the towing strip. Thus, a process is disclosed of towing a collector; scraping particles and sediment from the ocean bottom at the collector; concentrating the particles at the collection point interior of the collector, free of ambient sediment; and, continuously conveying in a series of buckets the particles to a collection area above the surface of the sea.

OBJECTS AND ADVANTAGES OF THE INVENTION

An object of this invention is to provide a towed collection apparatus which harvests from an ocean floor particles at a central collection point. According to this aspect of the invention, a towed sled sliding along the ocean floor is provided with an interior central collection area which concentrates and collects particles, such as nodules, from the ocean floor.

An advantage of this aspect of the invention is that the sled provides a single collection point. This single collection point can be monitored, typically by television cameras. This monitoring enables the interior workings of the sled to be observed as well as a judicious selection of the path along which the sled is towed.

A further advantage of the towed sled of this invention is that the submarine mining apparatus herein disclosed can systematically harvest side-by-side rows from a mineral rich ocean bottom. An efficient and systematic harvest of the mineral-bearing sea botttom can occur.

A further object of this invention is to provide for simplified collection at a towed vehicle being moved along the ocean floor. According to this aspect of the invention, particles are dislodged from the ocean floor, collected and concentrated interior of the towed vehicle, and thereafter conveyed to the surface.

An advantage of this aspect of the invention is that the towed vehicle or sled moving along the ocean floor need not be complicated by internal motorization. The problems of wheel slippage on the ocean bottom sediment or ooze, engine failure and the like, are not present.

A further advantage of this towed vehicle is that the towing can occur at a single point on the stern of a conventional towing vessel. Thus, the apparatus herein disclosed adapts in large measure to existent standard marine towing practices.

Yet another advantage of this invention is that the towing strip itself can be manufactured to be neutrally buoyant. Thus, the vessel does not have to support the weight of the long towing strip as it descends to the ocean floor.

Yet a further advantage of the towed sled of this invention is that the apparatus easily accommodates elevational changes between the surface vessel and the towed sled. Due to the angular disposition of the towing strip, rises and falls in the elevation of the sled with respect to the towing vessel caused either by ocean swells or changes in the level of the ocean bottom can easily be accommodated.

Yet another object of this invention is to provide an apparatus for the elevation of whole, unpulverized particles from the ocean floor. According to this aspect of the invention, the towed strip defines separate descending and ascending railways to and from the towed sled. Buckets, typically on an endless belt, are conveyed on the strip to the collecting vehicle along a first track or railway, are filled at the sled with the harvested particles, and thereafter are conveyed to the surface along a second and separate track or railway.

An advantage of this aspect of the invention is that there is minimum opportunity for entanglement of the buckets. Since they are essentially confined to discrete tracks on the towing strip of the sled, entanglement is minimized.

A further advantage of this aspect of the invention is that pulverization at the sea bottom of the harvested mineral is not required, and transportation of the particles to the surface is in a substantially unpulverized form.

Yet another aspect of this invention is that the elevator apparatus herein disclosed does not elevate substantial portions of sediment into the layers of water overlying the ocean bottom. Thus, the disturbance of the sediment that does occur is confined essentially to those layers of water adjacent the ocean bottom. In these layers, the sediment does not constitute a serious pollutant and can settle immediately back to the ocean floor without endangering sea life in the overlying ocean levels.

Yet another object of this invention is to disclose a structural mechanism for supporting an elevator apparatus from a vehicle towed on the ocean floor. According to this aspect of the invention, the towing strip under tension supports the elevator apparatus used in this invention.

An advantage of this aspect of the invention is that the use of a long, rigid, structural member extending from the vessel to the ocean floor is not required.

Yet another aspect of this invention is that the towing strip itself can conform to the hydrodynamic forces on it experienced during towing.

Other objects, features and advantages of this invention will become more apparent after referring to the following specification and attached drawings in which:

FIG. 3 is a side elevation of the mineral harvesting sled of this invention;

FIG. 4 is a plan view of the mineral harvesting sled;

Figure 1:
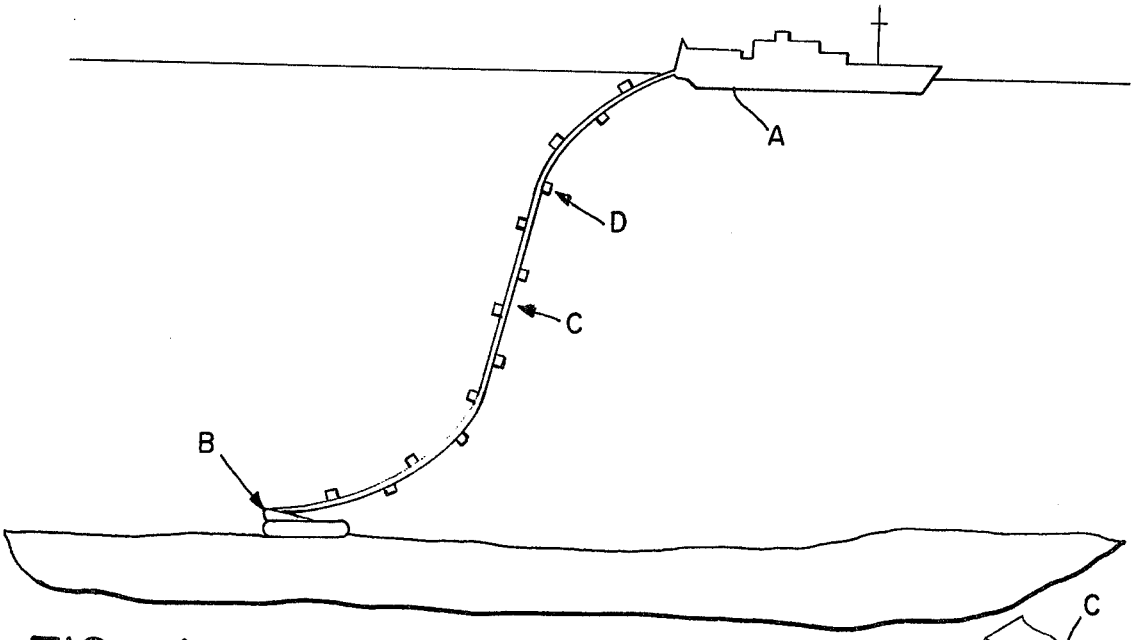
FIG. 1 is a side elevation section of a towing vessel on the surface pulling the ocean bottom mining apparatus or sled of this invention along a sea bottom.

Referring to FIG. 1, towing vessel A is shown towing sled B with flexible strip C. Strip C has conveyed thereon a series of buckets D which serve to empty particles harvested at the sled, elevate them along strip C and deposit them interior of the vessel A.

Figure 2:
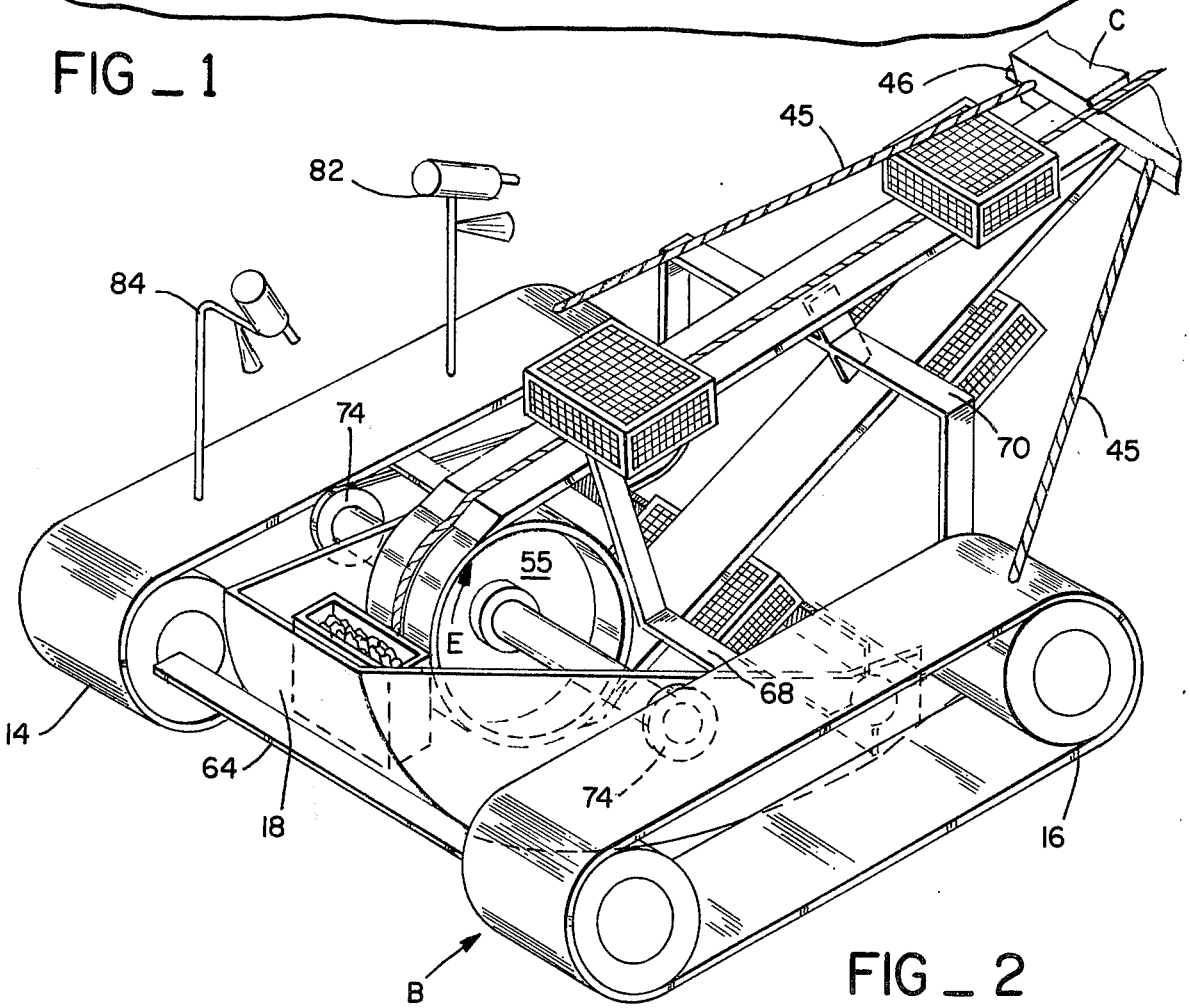
FIG. 2 is a perspective view of the mineral harvesting apparatus or sled of this invention.

In order to understand the apparatus here shown, it will be convenient first to set forth and discuss the sled with reference to FIGS. 2–4. Thereafter, the conveying strip C and the series of endless buckets D will be set forth with reference to FIG. 5. Finally, the handling of the strip C and buckets D on vessel A will be set forth with respect to FIG. 6.

Referring to FIGS. 2–4, towing sled B consists of paired runners 14, 16 and intermediate particle gathering through 18. Particle gathering trough 18 includes an arcuate bottom wall 20 and two converging sidewalls 22, 23. As will hereinafter be set forth fully and in more detail, particles harvested pass interiorly of trough 18 along the arcuate bottom and end wall 20. Simultaneously, particles are converged by the sidewalls, 22, 23 into the path of the elevator mechanism E.

Preferably, each of the tracks 14, 16 of the sled B is approximately 2 meters wide. The open front leading edge 26 of the trough between the tracks is approximately 6 meters wide. The entire sled is considerably heavier than the density of water so that during towing it will pass in a mineral collecting contact with the ocean bottom.

It should be noted that both the width of tracks 14, 16 as well as the width of trough 18 will be a design function of the size of the ocean floor being mined.

At leading edge 26, the sled is provided with a scarifyer 30 (shown in the views of FIGS. 3 and 4). Two important features should be noted about the scarifyer 30. First, it penetrates with individual spaced apart tines into the layer of mineral particles 34 and sediment 36 to classify out the mineral particles. Thus, the minimum spacing between the individual tines of the scarifyer 30 is such that the sediment can pass between the tines while the desired mineral particles cannot pass between the tines. For example, where mineral particles of up to 2 centimeters of diameter are to be harvested, the spacing between the individual tines of the scarifyer would be in the order of less than 2 centimeters.

Second, the scarifyer is mounted well aft of the leading edge of the sled tracks 14, 16. This is done so that the track can bear down on the ooze or sediment of the ocean floor and prevent the sled from overturning forwardly due to the interaction of the sled being towed and the penetration of scarifyer 30 into the ocean bottom.

Rearwardly of scarifyer 30 the sled B is provided with a series of fore and aft slats 34. Slats 34 extend slightly above the elevation of the tracks 14, 16 and extend rearwardly to and are part of the bottom arcuate wall 20 of the collector trough 18.

Overlying the collector trough entrance, rearwardly of the scarifyer 30, there is a rotating brush 40. Rotating brush 40 is typically driven by belt mechanisms 41 from the elevator mechanism E.

The function of brush 40 can be readily understood. As the sled B is pulled through and along the sediment water interface at the bottom of the sea, scarifyers 30 will dislodge and cause the accumulation immediately behind its leading edge of mineral particles from the ocean bottom. These particles will be contacted by rotating brush 40, urged over the slats 34, and downwardly into the arcuate bottom 20 of the collector trough 18.

It will be understood that once the particles are contacted by the scarifyer 30, classification of the particles from the ambient sediment or ooze on the ocean floor will begin.

As the particles are brushed by rotating brush 40 over the slats 34, classification of the particles from the ambient sediment or ocean bottom ooze will occur due to at least three effects.

First, brush 40 will tend to knock the particles rearwardly and, at the same time, cause the sediment 36 in which they are found to pass between the spatial intervals defined by the fore and aft slats 34. Secondly, rotating brush 40 will, by virtue of its individual tines 42, winnow away the sediment from around the particles. Finally, the sled itself being towed through the water will tend to leave in its wake the agitated sediment while the mineral particles are retained interiorly of the trough 18.

Towing of the sled occurs through two cables 45 attached at runners 14, 16 at points 47 at the upper forward end of the runners with each cable converging upwardly to a towing bridle 46. Towing bridle 46 is in turn connected to the lower end of the strip C and is the point at which sled B is towed along the ocean floor. As will hereinafter become more apparent, strip C and buckets D serve together to tow sled B and empty sled B to vessel A as sled B moves along the ocean floor.

Buckets D are conveyed into the interior of trough 18 along a bottom railway 50 on strip C. They then pass between the wheel 55 of elevator mechanism E and strip C on a track 52. These individual buckets D are conveyed on an endless cable 54 in a defined groove 56 on wheel 55 so as to pass around that portion of wheel 55 in contact with endless cable 54. It should be noted that wheel 55 is provided with a rim 58 to hold bucket D securely and radially outward of wheel 55.

It should be appreciated that the buckets pass along arcuate bottom 20 of trough 18 along a tangent with respect to the ocean bottom which is the reverse of the direction in which sled B is towed. Thus, the buckets will not only serve to gather in at their open end 57 particles to be harvested, but will additionally cause the rearward converging movement of the ocean bottom particles at their leading and open end.

As can be seen, each open ended bucket D will sweep in close proximity to the arcuate bottom 20 of trough 18. Thereafter, the buckets will be conveyed to an overlying track 60 extending between wheel 55 and strip C. Finally, bucket D will be conveyed to the upper surface 62 of strip C at towing bridle 46.

To support both the trough 18 and the runners 14, 16, as well as the conveyer paths 52, 60, a series of cross braces 64, 68 and 70 are provided. These respective cross braces maintain the spatial separation between the runners 14, 16 of the sled, hold the trough 18 intermediately of the paired sled runners, and additionally furnish the structural support for the bucket paths 52, 60 between the wheel 55 and the towing bridle 46.

It should be apparent that rotating brush 40 can be powered by an electric motor mounted interiorly of the sled B. Preferably, however, wheel 55 is connected to a shaft 72 which transpierces sides 22, 23 of trough 18 and extends to belt wheels 74 proximate runners 14, 16. Wheels 74, through belt mechanisms 41, power belt driving wheels 76 to cause rotation to the winnowing brush 40.

It should be appreciated that the sled, as towed along the ocean bottom, will be subject to vibrations. Vibrations can be expected from the motion of the scarifyer 30 through the sediment mineral particle interface 34, 36 as well as the vibration of the elevator mechanism collecting and elevation harvested mineral particles 34 and the action of rotating brush 40. As this occurs, it will be appreciated that particles accumulated on slats 34 will tend to fall backwardly and downwardly on arcuate wall 20 of the trough 18 to the elevator mechanism E.

It will be remembered that the sled B has the additional advantage of forming a central and moving collection point which can be monitored. Accordingly, two television monitors and accompanying lights on standards 82, 84 are shown. Light and camera 82 illuminate the path into which the sled is being towed. The density and configuration of mineral particles about to be harvested in the anticipated path of the sled can be observed.

Camera and light 84 monitor the elevator apparatus interior of the sled. The accumulation of mineral particles can be observed with correspondent adjustments to the towing speed of sled B or the rate of elevator E as it evacuates particles accumulated interior of trough 18 of the collector sled B.

Figures 5, 5A:
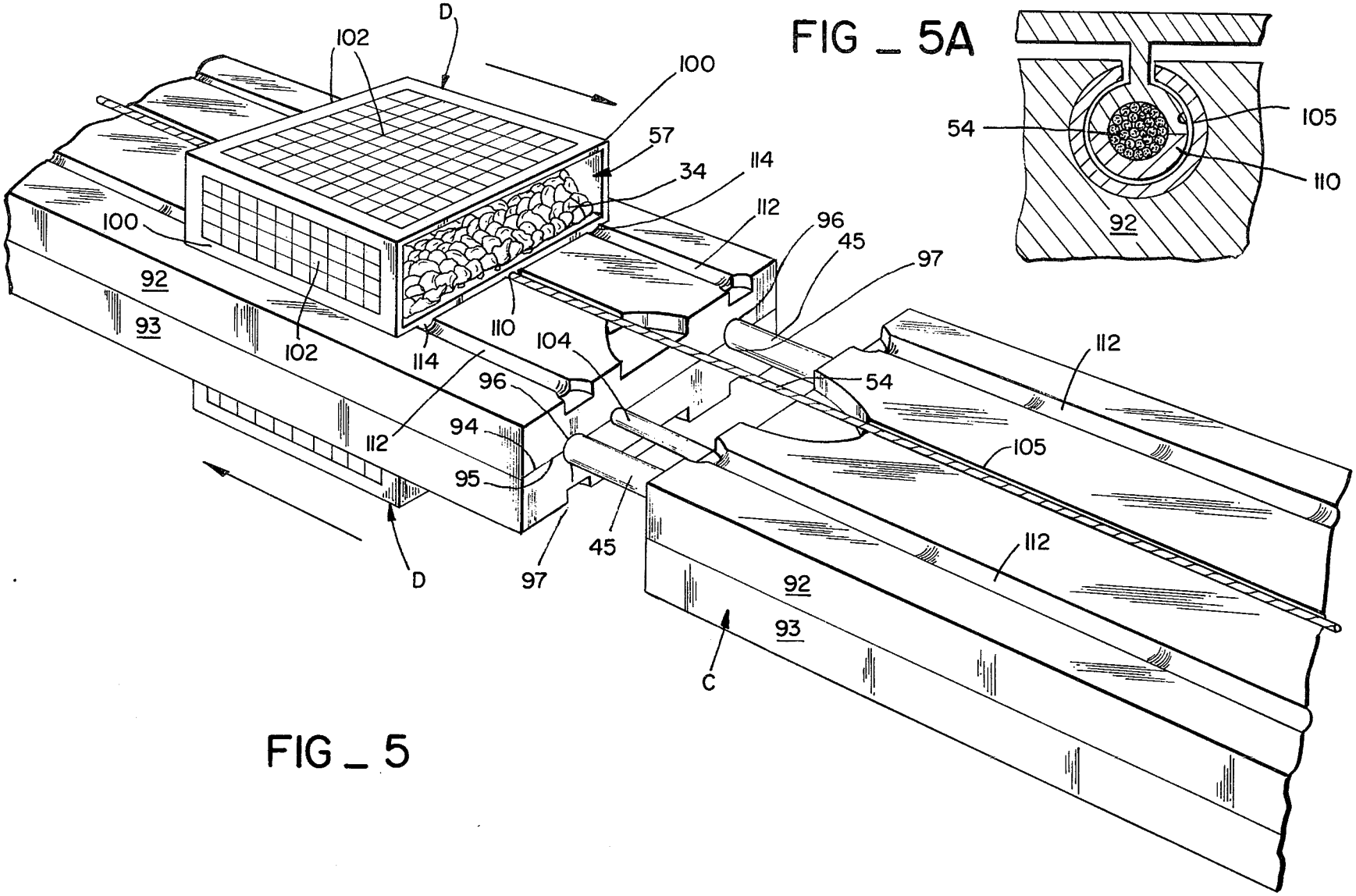
FIG. 5 is a perspective view of the towing strip and conveyed buckets.
FIG. 5A is a view of the cable and grip for confining the conveyed buckets to a path adjacent the towing strip; and, FIG. 6 is a perspective view of the fan tail of the towing ship illustrating the handling of the towing strip and endless belt conveyed buckets.

Referring to FIGS. 5 and 5A, the construction of the towing strip C can be understood. Typically, cables 45 extend from sled B at the lower end to the fan tail of the towing vessel A at the upper end. These cables 45 are reeved at conventional winches 90 on the stern or fan tail of the towing vessel A. (See FIG. 6) The towing cables 45 are typically neutrally buoyant and are preferably constructed of a material having neutral density with respect to sea water. This cable construction material is known as Kelvar, a registered trademark of E. I. DuPont De Nemours and Company of Wilmington, Delaware.

Intermediate sled B and vessel A, cables 45 are held in spaced apart relation by upper track members 92 and lower track members 93. These respective track members are confronted at respective mating surfaces 94, 95 and cable grooves 96, 97 to hold the spaced apart cables 45 at an equidistant and parallel spacing from the sled B on the ocean floor to the fan tail of the towing vessel A.

Preferably, track sections 92, 93 are also neutrally buoyant. Thus, as the cable passes from the sled to the vessel, the buoyant force of the sea water essentially supports the weight of the towing strip C and its upper and lower tracks 92, 93.

Buckets D include an angle frame 100 which is closed by screen 102 at bucket sides and end and is open in the direction of conveyance at an opening 57. As is apparent, when the buckets are conveyed along the strip C, water passses through the buckets and through the screen 102 at the sides and end while the harvested particles 34 are captured and thereafter elevated to the surface. Thus, the buckets and the water passing through them can serve to winnow away any remaining sediment 36 from the collected mineral particles 34.

It should be apparent that strip C also forms a convenient conduit for passing protected communication and power cables to sled B. Such communication and power cables are schematically shown at 104.

The drawing of the buckets D along the towing strip C occurs by means of a traveling endless cable 54 captured interiorly of a cable raceway 105. The individual buckets D are fastened to cable 54 by grips 110 which penetrate interiorly of raceway 105.

It should be noted that the cable grips are captured within the raceway 105. Thus, the grips 110 serve a dual purpose. First, they serve to convey the buckets D upwardly and to the surface of the towing vessel A. Secondly, they serve to capture the individual buckets and hold them on the respective railways 92.

Buckets D slide along grooves 112 at runners 114. These runners serve to preserve the alignment of the buckets D as they pass upwardly and downwardly of the towing track C with their respective open ends 57 confronted to the direction of their movement.

It should be understood that with respect to FIG. 5, only one side of the outwardly exposed section of track 92 has been specifically illustrated. The downwardly exposed track section 93 is of identical construction and therefore is not set forth.

Additionally, it should be apparent that discrete sections of track 92, 93 are fastened along between the cables 45 as they pass from the sled B to the vessel A. Preferably, these track sections are juxtaposed and are not given the spacing shown in FIG. 5, which spacing is only present for increased understanding of the makeup of the towing strip C.

Additionally, it will be apparent that where both the cable raceway 105 and the respective grooves 112 come into contact between adjoining segments of the tracks 92, 93, flaired portions enlarging these respective grooves and raceways are provided. This is done so that the buckets may easily pass from one discrete track segment to an adjoining or adjacent track segment.

Figure 6:
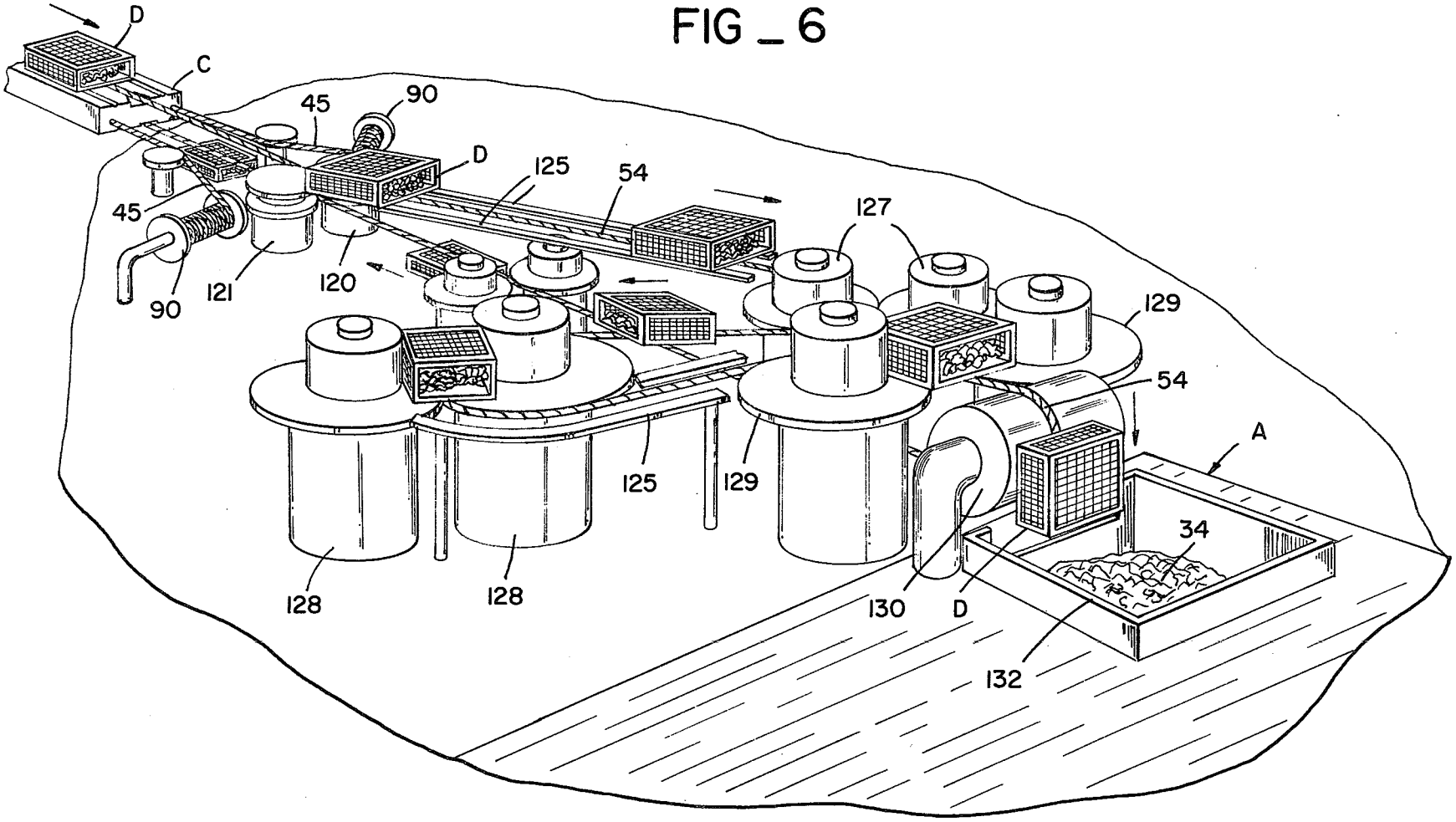

Referring to FIG. 6, the handling of the buckets D on the fan tail of the towing vessel A is schematically illustrated in a perspective view. Buckets D pass off the surface of the strip C and between idling capstans 120 and 121. These buckets D are kept on top of the endless cable 54 to which they are attached by rail 125, which rails are only partially shown in the perspective view of FIG. 6. The buckets pass around and between three pairs of driving capstans 127, 128, 129. The driving capstans, by winding a section of the endless cable 54 around their periphery and imparting a zigzag configuration to the endless belt 54, provide the power to pull the buckets from the towed sled B to the vessel A. Cable 54 passes over an emptying drum 130 and empties the elevated mineral particles 34 into a vessel mounted collection bin 132. The endless belt and its respective buckets D then return to the underside of strip C between idler capstans 120, 121 to the ocean floor.

It should be apparent that the invention herein disclosed will admit of modification. For example, the towing track C and the configuration of both the driving endless belt 54, the cable grip 110 as well as any mechanism which holds the buckets D firmly to the track can be altered. Likewise, other modifications of this invention as disclosed herein can occur.

We claim:

1. An apparatus for harvesting particles from the deep-sea bottom comprising: a towing vessel on the surface of the sea; a towed vehicle at the bottom of the ocean, said towed vehicle arranged for collection of mineral particles from the ocean bottom along its towed path and defining there within a trough for the collection of particles received during towed movement along the ocean floor; a towing strip connected to said vehicle at the lower end, connected to said towing vessel at the upper end, and extending angularly downward under tension from the vessel to the vehicle during towing; an elevator mechanism affixed to said towing strip between said vessel and said vehicle and including a first track defined on one portion of said towing strip and a second and separate track defined on another portion of said towing strip; a series of buckets for conveyance to the vehicle on said first track, from the vehicle on said second track; and, first means at said vehicle for loading said buckets and second means on said vessel for emptying said buckets.

2. The apparatus of claim 1 and wherein said trough in said towed vehicle at the bottom of the sea opens upwardly and away from the sea floor and said elevator mechanism includes a wheel for passing said buckets through and around said trough to empty particles accumulated interiorly of said trough.

3. The invention of claim 1 and wherein said towed vehicle includes a scarifyer at the leading edge of said towed vehicle.

4. The invention of claim 1 and wherein said towed vehicle includes first and second surfaces in contact with the ocean bottom on either side of said trough in said vehicle for the sliding movement of said vehicle across the ocean bottom.

5. The invention of claim 1 and wherein said towed vehicle includes means for monitoring vehicle operation operably connected from said vehicle through said towing strip to said towing vessel.

6. A process of collecting particles from the deep-sea bottom to the surface of the ocean comprising the steps of: providing a collector for collecting particles on the sea bottom during towed movement of said collector across the sea bottom; providing a towing strip connected to said collector at the bottom of the ocean and extending angularly upward to a towing point at the surface of the ocean; towing said collector by towing said strip at said towing point along a predetermined path over the ocean floor to maintain a tension force in said towing strip; conveying on said towing strip at least one collecting bucket along a first path on said strip to collect particles at said collector; and, elevating said bucket on a second path on said towing strip to elevate particles from the ocean floor to the ocean surface.

7. The invention of claim 6 and wherein said conveying and elevating steps include the steps of providing an endless belt; confining said endless belt along a first path on said towing strip from the surface of the ocean to said collector and confining the remaining segment of said belt on a second path on said towing strip from said collector to the surface of said ocean and rotating said endless belt from the surface to cause said buckets to pass to said collector and from said collector to elevate particles from said ocean bottom.

8. The invention of claim 6 and including providing an arcuate path at said collector for said one collecting bucket to pass through said collector and passing said bucket through said collector to fill said bucket at said collector.

9. A process of collecting particles from the deep-sea bottom to the surface of the ocean comprising the steps of: providing a collector having an open end for collecting particles on the sea bottom during towed movement of said collector across the sea bottom; providing a towing strip connected to said collector at the bottom of the ocean and extending angularly upward to a towing point at the surface of said ocean; towing said collector by towing said strip at said towing point along a predetermined path over the ocean floor to maintain a tension force in said towing strip; winnowing said particles as they are collected at the leading edge of said collector on said sea bottom during towed movement of said collector across the sea bottom; conveying on said towing strip at least one collecting bucket along a first path on said strip to collect particles at said collector; and, elevating said bucket on a second path on said towing strip to elevate particles from the ocean floor to the ocean surface.

10. The invention of claim 9 and wherein said winnowing step includes providing a rotating brush adjacent the leading edge of said collector and rotating said brush adjacent said particles to winnow away ambient sediment from said particles.

11. The process of claim 9 and wherein said winnowing step includes the step of passing a scarifyer through the soil water interface of the floor of said ocean to dislodge said particles from the ambient sediment through which said collector is towed.

12. The process of claim 9 and wherein said winnowing step is supplemented by passing water through said particles during said elevating step.

* * * * *